US007608576B2

(12) United States Patent
Company et al.

(10) Patent No.: US 7,608,576 B2
(45) Date of Patent: Oct. 27, 2009

(54) WETTING COMPOSITION AND ITS USE

(75) Inventors: Mahnaz Company, Hisings Backa (SE); Anette Thyberg, Stenungsund (SE)

(73) Assignee: Akzo Nobel N.V. (NL)

( * ) Notice: Subject to any disclaimer, the term of this patent is extended or adjusted under 35 U.S.C. 154(b) by 195 days.

(21) Appl. No.: 10/555,578

(22) PCT Filed: Apr. 22, 2004

(86) PCT No.: PCT/SE2004/000614

§ 371 (c)(1),
(2), (4) Date: Nov. 4, 2005

(87) PCT Pub. No.: WO2004/099355

PCT Pub. Date: Nov. 18, 2004

(65) Prior Publication Data

US 2007/0042925 A1 Feb. 22, 2007

(30) Foreign Application Priority Data

May 7, 2003 (SE) ..... 0301312

(51) Int. Cl.
*C11D 3/22* (2006.01)

(52) U.S. Cl. ..... 510/470; 510/108; 510/238; 510/239; 510/240; 510/276; 510/356

(58) Field of Classification Search ..... 510/108, 510/238, 239, 240, 276, 356, 470
See application file for complete search history.

(56) References Cited

U.S. PATENT DOCUMENTS

| | | | | |
|---|---|---|---|---|
| 4,240,921 | A * | 12/1980 | Kaniecki | 510/422 |
| 4,416,792 | A | 11/1983 | Blackstone | 252/110 |
| 4,797,223 | A * | 1/1989 | Amick et al. | 510/223 |
| 6,541,442 | B1 * | 4/2003 | Johansson et al. | 510/470 |
| 6,732,748 | B2 | 5/2004 | Kahre et al. | 134/25.2 |
| 2003/0162686 | A1 * | 8/2003 | Johansson et al. | 510/470 |

FOREIGN PATENT DOCUMENTS

| | | |
|---|---|---|
| EP | 0669907 B1 | 5/1997 |
| EP | 0845449 B1 | 9/2002 |
| WO | WO 96/29384 | 9/1996 |
| WO | WO 97/32967 | 9/1997 |
| WO | WO 99/21948 | 5/1999 |
| WO | WO 99/38942 | 8/1999 |
| WO | WO 01/55288 A1 | 8/2001 |

OTHER PUBLICATIONS

International Search Report, No. PCT/SE2004/000614, Aug. 24, 2004.
Database WPI; Week 199646;Derwent Abstract JP8231998; Sep. 10, 1996.
HCA Copyright 2004 ACS on STN, HCA accession No. 130:97202, Kao Corp: "Detergent compositions for hard surfaces," JP,A2,103249900, 19981208.
R. Sowanda et al., "Calculation of HLB Values," Physical Chemistry, pp. 109-113 (1992).
English Translation of Japanese Publication No. 2000-169894, Jun. 20, 2000, pp. 14.

* cited by examiner

*Primary Examiner*—Mark Eashoo
*Assistant Examiner*—M. Reza Asdjodi
(74) *Attorney, Agent, or Firm*—Ralph J. Mancini; James C. Abruzzo

(57) ABSTRACT

The present invention relates to an aqueous alkaline composition with good wetting ability, which composition is dilutable with water without exhibiting any phase separation. The composition contains a surface active nonionic alkylene oxide adduct of an alkyl-branched alcohol, with a good wetting ability, a hexyl glycoside and/or an octyliminodipropionate and a further surface active nonionic alkylene oxide adduct having an HLB-value according to Davies of at least 6.4. The Compositions may be used for the cleaning of hard surfaces, in scouring and mercerizing processes and for laundry.

19 Claims, No Drawings

WETTING COMPOSITION AND ITS USE

This case was filed under the Patent Cooperation Treaty on Apr. 22, 2004 and claims priority of Swedish application No. 0301312-5 filed on May 7, 2003.

The present invention relates to an aqueous alkaline composition with good wetting ability, which composition is dilutable with water without exhibiting any phase separation. The composition contains a surface active nonionic alkylene oxide adduct of an alkyl-branched alcohol, with a good wetting ability, a hexyl glycoside and/or an octyliminodipropionate, and a further surface active nonionic alkylene oxide adduct having an HLB-value according to Davies of at least 6.4, suitably between 6.4 and 15.0.

The ability of an aqueous solution to spread evenly over a surface, the so-called wetting ability, is an important property for alkaline cleaning solutions in general, especially for the cleaning of hard surfaces. Good wetting is also desirable for laundry, and scouring and mercerizing processes. For example, the patent publications EP 845 449 and EP 669 907 describe low-foaming alkylene oxide adducts of alcohols with branched alkyl groups, that are used in cleaning compositions as wetting agents. The compositions also contain an ethoxylated quaternary fatty amine compound as a hydrotrope, to be able to form clear homogeneous concentrates with alkali or alkaline complexing agents in water. However, this kind of hydrotrope is not readily biodegradable. In WO 99/21948, it has been disclosed that a hexyl glycoside is a good hydrotrope for nonionic alkylene oxide adducts of both branched and linear alcohols in alkaline solutions, and in WO 96/29384 2-ethylhexyliminodipropionate is disclosed for the same purpose.

However, tests have shown that clear and homogeneous, alkaline concentrates, containing alkylene oxide adducts of a $C_8$-$C_{12}$ alkyl branched alcohol and hexyl glucoside and/or an octyliminodipropionate as a hydrotrope, will become hazy or separate when they are diluted to make ready-to-use solutions.

Now it has surprisingly been found that an aqueous concentrate containing an alkylene oxide adduct of a $C_8$-$C_{12}$ alkyl-branched alcohol, an alkali hydroxide and/or an alkaline complexing agent and a hexyl glycoside and/or an octyliminodipropionate, to which concentrate has further been added a second surface active nonionic alkylene oxide adduct with an HLB-value of at least 6.4 according to Davies, does not become hazy or separate when diluted to make a ready-to-use composition. The procedure for calculation of HLB-values according to Davies is described in Tenside Surfactants Detergents 29 (1992) 2, page 109, and references therein. The composition has a good wetting ability, is stable and clear within a large temperature and pH-range, and is readily biodegradable. The composition is normally intended to be used between 5-50° C., suitably between 15-35° C.

The clear homogeneous aqueous ready-to-use composition contains a) 0.05-1% by weight of a nonionic alkylene oxide adduct of a $C_8$-$C_{12}$ alkyl-branched alcohol
b) 0.15-2.0% by weight of an alkali hydroxide and/or an alkaline complexing agent
c) 0.025-1.75% by weight of a hexyl glycoside and/or an octyliminodipropionate and
d) 0.025-1.25% by weight of a second surface active nonionic alkylene oxide adduct having an HLB-value of at least 6.4 according to Davies.

The amount of water in the ready-to-use composition is normally 94-99.7% by weight.

In the composition the weight ratio between the alkyl-branched alcohol alkylene oxide adduct and the sum of the hexyl glycoside and/or octyliminodipropionate and the second surface active nonionic alkylene oxide adduct is suitably between 1:0.75 to 1:5, preferably between 1:1 to 1:3. The optimal ratio will depend on the amount of alkali and/or alkaline complexing agent that is present in the composition. To make a stable composition with a high amount of alkaline components, the weight ratio of hexyl glycoside and/or octyliminodipropionate+second nonionic to alkyl-branched alcohol alkylene oxide adduct has to be high.

The nonionic alkyl-branched alcohol alkylene oxide adduct preferably has the formula $R_1O(PO)_m(CH_2CH_2O)_nH$, where $R_1$ is a branched alkyl group having 8-12 carbon atoms, preferably 8-10 carbon atoms, PO is a propyleneoxy group, m is a number between 0 and 3, preferably between 0 and 2, and n is a number between 1 and 8, preferably between 2 and 7 and most preferably between 3 and 6. Preferably the propyleneoxy groups are located next to the $R_1O$ group. Suitable examples are 2-ethylhexanol+3, 4 or 5 moles of ethylene oxide and 2-propylheptanol+4, 5 or 6 moles of ethylene oxide. Another example is 2-butyloctanol+5, 6 or 7 moles of ethylene oxide.

The hexyl glycoside has the formula $C_6H_{13}OG_n$, where G is a monosaccharide residue and n is from 1 to 5. The hexyl glycoside is preferably a hexyl glucoside, and the hexyl group is preferably n-hexyl.

The octyliminodipropionate has the formula

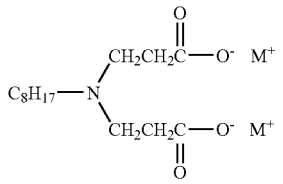

where $M^+$ is a monovalent cation, preferably $Na^+$ or $K^+$. Preferably the octyl group is the 2-ethylhexyl group.

The second surface active nonionic ethylene oxide adduct preferably has the formula $R_2O(C_2H_4O)_x(AO)_yH$, where $R_2$ is an alkyl group containing 9-20, preferably 9-14, carbon atoms, AO is an alkyleneoxy group with 3-4 carbon atoms, preferably 3 carbon atoms, x is a number between 5 and 100, preferably between 5 and 30, and most preferably between 5 and 20, and y is a number between 0 and 4, preferably between 0 and 2. The alkyl group could be linear or branched and saturated or unsaturated. When there are different alkyleneoxy groups present in the same compound, these may be added either randomly or in blocks. Suitable examples of nonionic ethylene oxide adducts are $C_9$-$C_{11}$ alcohol+8EO, $C_{11}$ alcohol+10EO, tridecyl alcohol+12.5EO, $C_{11}$ alcohol+12EO and $C_{10}$-$C_{14}$ alcohol+8EO+2PO. The second nonionic should have an HLB-value of at least 6.4 according to Davies, suitably between 6.4 and 15.0. If the value is lower, too much of the second nonionic is required to make a solution that stays clear and homogeneous when diluted. Nonionics having high HLB-values still works well. For example, the amount required of the product $C_{16}C_{18}$-alkyl alcohol+80EO, which has a HLB-value of 14.8 according to Davies, is about the same as for a product having a HLB value of 6.5 according to Davies.

The alkali hydroxide in the composition is preferably sodium or potassium hydroxide. The alkaline complexing agent may be inorganic as well as organic. Typical examples of inorganic complexing agents used in the alkaline composition are alkali salts of silicates and phosphates, such as sodium tripolyphosphate, sodium orthophosphate, sodium pyrophosphate, and the corresponding potassium salts. Typical examples of organic complexing agents are alkaline aminopolyphosphonates, organic phosphates, polycarboxylates, such as citrates; aminocarboxylates, such as sodium nitrilotriacetate ($Na_3NTA$), sodium ethylenediaminetetraacetate, sodium diethylenetriaminepentaacetate, sodium 1,3-propylenediaminetetraacetate and sodium hydroxyethylethylenediaminetriacetate.

The ready-to-use composition according to the invention is suitably prepared by diluting with water an aqueous concentrate containing:

a) 1.0-20%, preferably 2-10%, by weight of a nonionic alkylene oxide adduct of a $C_8$-$C_{12}$ alkyl-branched alcohol
b) 3.0-40%, preferably 5-30% by weight of an alkali hydroxide and/or an alkaline complexing agent
c) 0.5-35%, preferably 2-25% by weight of a hexyl glycoside and/or an octyliminodipropionate and
d) 0.5-25%, preferably 2-20% by weight of a second surface active nonionic alkylene oxide adduct having an HLB-value of at least 6.4 according to Davies.

The concentrate normally contains 50-95% by weight of water, suitably 70-90%.

To obtain a diluted composition that is clear, homogeneous and stable, it is preferred that the clarity interval of the concentrated solution is not to narrow. Suitably, the clarity interval should be at least 5-40° C., preferably at least 0-45° C., and the amounts of hexyl glycoside and/or octyliminodipropionate and second nonionic must be adapted accordingly.

The present invention is further illustrated by the following examples.

EXAMPLE 1A

This example illustrates the amounts of second surface active nonionic alkylene oxide adduct that is needed to obtain a clear homogeneous solution also when the cleaning concentrate is diluted 20 times. The test is performed by making clear and homogeneous aqueous concentrates containing a nonionic wetting agent, n-hexyl glucoside and an alkaline complexing agent, diluting the concentrates and adding a sufficient amount of second nonionic to obtain a clear homogeneous solution again.

The concentrates I-V were prepared by the following procedure:

10 g $Na_3NTA$ was dissolved in water, and 5 g of the respective nonionic wetting agent was added. The n-hexyl glucoside was added in such an amount that the concentrate became clear and homogeneous at room temperature.

TABLE 1A

| | Compound | | | | |
|---|---|---|---|---|---|
| | I | II | III | IV | V |
| 2-Ethyl-hexanol + 4EO | 5% (w/w) | | | | |
| 2-Propyl-heptanol + 5EO | | 5% (w/w) | | | |
| 2-Propyl-heptanol + 6EO | | | 5% (w/w) | | |
| C9-C11 straight chain alcohol + 5.5EO (Comparison) | | | | 5% (w/w) | |
| 2-Propyl-heptanol + 8EO (Comparison) | | | | | 5% (w/w) |
| $Na_3NTA$ | 10% (w/w) | 10% (w/w) | 10% (w/w) | 10% (w/w) | 10% (w/w) |
| n-Hexyl glucoside | 6.0% (w/w) | 6.0% (w/w) | 5.3% (w/w) | 3.0% (w/w) | 3.0% (w/w) |
| Water | 79.0% (w/w) | 79.0% (w/w) | 79.7% (w/w) | 82.0% (w/w) | 82.0% (w/w) |
| Clarity interval ° C. | 0-48 | 0-52 | 0-51 | 0-35 | 0-50 |

The concentrates I-V were then diluted 1:20 with water. The comparison formulations IV and V remained clear and homogeneous, but the formulations I-III became hazy. 100 ml of each of the hazy solutions were then removed, and to each of them was added the amount of second surface active nonionic alkylene oxide adduct that was required to obtain a clear homogeneous solution. These values for the different second nonionics are collected in Table 2A.

TABLE 2A

| Formulation | Second nonionic | HLB value Davies | Added amount of second nonionic (g) | Added amount × 20 (g) |
|---|---|---|---|---|
| I | $C_{10}C_{14}$-alcohol + 8EO + 2PO | 6.5 | 0.081 | 1.62 |
| I | $C_{11}$-alcohol + 10EO | 7.18 | 0.094 | 1.88 |
| II | $C_{10}C_{14}$-alcohol + 8EO + 2PO | 6.5 | 0.153 | 3.06 |
| II | $C_{11}$-alcohol + 10EO | 7.18 | 0.145 | 2.90 |
| II | $C_{11}$-alcohol + 12EO | 8.26 | 0.13 | 2.6 |
| II | Tridecylalcohol + 12.5EO | 7.1 | 0.15 | 3.0 |
| II | Tridecylalcohol + 14EO | 7.63 | 0.14 | 2.8 |
| II | $C_{16}C_{18}$-alcohol + 80EO | 14.8 | 0.2 | 4.0 |
| II | $C_9C_{11}$-alcohol + 8EO | 6.86 | 0.16 | 3.2 |
| II | $C_9C_{11}$-alcohol + 6EO (Comparison) | 6.16 | 0.27 | 5.4 |
| II | $C_{13}$-alcohol + 10EO (Comparison) | 6.22 | 0.29 | 5.8 |
| II | $C_{12}$-alcohol + 7EO (Comparison) | 4.96 | 0.6 | 12.0 |
| III | $C_{10}C_{14}$-alcohol + 8EO + 2PO | 6.5 | 0.081 | 1.62 |
| III | $C_{11}$-alcohol + 10EO | 7.18 | 0.077 | 1.54 |

From the values in Table 2A it is evident that a much smaller amount is required to obtain a clear homogeneous solution when the second nonionic has an HLB-value above 6.4.

EXAMPLE 1B

This example illustrates the amounts of second surface active nonionic alkylene oxide adduct that is needed to obtain a clear homogeneous solution also when the cleaning concentrate is diluted 20 times. The test is performed by making clear and homogeneous aqueous concentrates containing a nonionic wetting agent, 2-ethylhexyliminodipropionic acid sodium salt and an alkaline complexing agent, diluting the concentrates and adding a sufficient amount of second nonionic to obtain a clear homogeneous solution again.

The concentrates I-V were prepared by the following procedure:

10 g $Na_3NTA$ was dissolved in water, and 5 g of the respective nonionic wetting agent was added. The 2-ethylhexyliminodipropionic acid sodium salt was added in such an amount that the concentrate became clear and homogeneous at room temperature.

TABLE 1B

| | Compound | | | | |
|---|---|---|---|---|---|
| | I | II | III | IV | V |
| 2-Ethyl-hexanol + 4EO | 5% (w/w) | | | | |
| 2-Propyl- | | 5% | | | |

TABLE 1B-continued

| | Compound | | | | |
|---|---|---|---|---|---|
| | I | II | III | IV | V |
| heptanol + 5EO | | (w/w) | | | |
| 2-Propyl-heptanol + 6EO | | | 5% (w/w) | | |
| C9-C11 straight chain alcohol + 5.5EO (Comparison) | | | | 5% (w/w) | |
| 2-Propyl-heptanol + 8EO (Comparison) | | | | | 5% (w/w) |
| $Na_3NTA$ | 10% (w/w) | 10% (w/w) | 10% (w/w) | 10% (w/w) | 10% (w/w) |
| 2-ethylhexyl-iminodi-propionate (sodium salt) | 3.2% (w/w) | 3.2% (w/w) | 2.8% (w/w) | 2.4% (w/w) | 1.2% (w/w) |
| Water | 81.8% (w/w) | 81.8% (w/w) | 82.2% (w/w) | 82.6% (w/w) | 83.8% (w/w) |
| Clarity interval ° C. | 0-47 | 0-43 | 0-47 | 0-44 | 0-44 |

The concentrates I-V were then diluted 1:20 with water. The comparison formulations IV and V remained clear and homogeneous, but the formulations I-III became hazy. 100 ml of each of the hazy solutions were then removed, and to each of them was added the amount of second surface active nonionic alkylene oxide adduct that was required to obtain a clear homogeneous solution. These values for the different second nonionics are collected in Table 2B.

TABLE 2B

| Formulation | Second nonionic | HLB value Davies | Added amount of second nonionic (g) | Added amount × 20 (g) |
|---|---|---|---|---|
| I | $C_{10}C_{14}$-alcohol + 8EO + 2PO | 6.5 | 0.072 | 1.44 |
| I | $C_{11}$-alcohol + 10EO | 7.18 | 0.119 | 2.38 |
| II | $C_{10}C_{14}$-alcohol + 8EO + 2PO | 6.5 | 0.162 | 3.24 |
| II | $C_{11}$-alcohol + 10EO | 7.18 | 0.16 | 3.23 |
| II | $C_{11}$-alcohol + 12EO | 8.26 | 0.18 | 3.6 |
| II | Tridecylalcohol + 12.5EO | 7.1 | 0.11 | 2.2 |
| II | Tridecylalcohol + 14EO | 7.63 | 0.11 | 2.2 |
| II | $C_{16}C_{18}$-alcohol + 80EO | 14.8 | 0.2 | 4.0 |
| II | $C_9C_{11}$-alcohol + 8EO | 6.86 | 0.22 | 4.4 |
| II | $C_9C_{11}$-alcohol + 6EO (Comparison) | 6.16 | 0.27 | 5.4 |
| II | $C_{13}$-alcohol + 10EO (Comparison) | 6.22 | 0.29 | 5.8 |
| II | $C_{12}$-alcohol + 7EO (Comparison) | 4.96 | 0.47 | 9.4 |
| III | $C_{10}C_{14}$-alcohol + 8EO + 2PO | 6.5 | 0.144 | 2.88 |
| III | $C_{11}$-alcohol + 10EO | 7.18 | 0.102 | 2.04 |

From the values in Table 2B it is evident that a much smaller amount is required to obtain a clear homogeneous solution when the second nonionic has an HLB-value above 6.4.

EXAMPLE 2

In Table 3 and 4 a number of different formulations are collected with specified clarity intervals. All solutions contain 10% (w/w) of $Na_3NTA$.

Procedure for preparing the solutions: 10 g of $Na_3NTA$ was dissolved in 75 g of water. The alkyl branched alcohol alkylene oxide adduct and the second nonionic were added, the total amount of the two compounds being 5 g, and then hexyl glucoside was added in such an amount that the composition exhibited a clarity interval between 0° C. to ca 45-60° C. Water was then added in such an amount that the total weight of the composition was 100 g. The concentrate was diluted 1:10 with water. After 2 days the stability/clarity intervals of the diluted compositions were noted.

TABLE 3

| Composition | 2-Propyl-heptanol + 5EO % (w/w) | $C_{10}C_{14}$-alcohol + 8EO + 2PO % (w/w) (HLB = 6.5) | n-hexyl glucoside % (w/w) | Clarity interval for concentrate (° C.) | Diluted 1:10 Stability/clarity interval after 2 days |
|---|---|---|---|---|---|
| 1 | 5.0 | | 6.0 | 0-52 | Separated |
| 2 | 4.5 | 0.5 | 6.0 | 0-55 | Separated |
| 3 | 4.0 | 1.0 | 6.0 | 0-57 | Hazy |
| 4 | 3.5 | 1.5 | 6.0 | 0-60 | Hazy |
| 5 | 3.0 | 2.0 | 6.0 | 0-59 | 0-40 |
| 6 | 3.0 | 2.0 | 5.3 | 0-54 | 0-32 |
| 7 | 3.0 | 2.0 | 4.5 | 0-46 | 0-32 |

This example shows that the even if the clarity interval of the concentrate is rather broad, a certain minimum amount of the second nonionic is required to obtain the desired stability of the diluted composition.

TABLE 4

| Composition | 2-Propyl-heptanol + 5EO % (w/w) | $C_9C_{11}$-alcohol + 8EO % (w/w) (HLB = 6.9) | n-hexyl glucoside % (w/w) | Clarity interval for concentrate (° C.) | Diluted 1:10 Stability/clarity interval after 2 days |
|---|---|---|---|---|---|
| 8 | 3.5 | 1.5 | 6.0 | 0-64 | 0-39 |
| 9 | 3.0 | 2.0 | 6.0 | 0-68 | 0-42 |
| 10 | 3.5 | 1.5 | 5.3 | 0-54 | Hazy |
| 11 | 3.0 | 2.0 | 5.3 | 0-60 | 0-37 |
| 12 | 3.0 | 2.0 | 4.5 | 0-57 | 0-37 |
| 13 | 3.0 | 2.0 | 3.8 | 0-42 | 0-35 |
| 14 | 3.0 | 2.0 | 3.0 | 0-35 | 0-36 (hazy after 10 days) |

This example shows that the amount of hexyl glycoside added to the concentrate affects the clarity interval. It is the combined effect of the amount of hexyl glycoside and the second nonionic that endows stability to the diluted composition.

TABLE 5

| Composition | 2-Propyl-heptanol + 5EO % (w/w) | $C_9C_{11}$-alcohol + 5.5EO % (w/w) (HLB = 6.0) | $C_{13}$-alcohol + 10EO % (w/w) (HLB = 6.2) | $C_{12}$-alcohol + 7EO % (w/w) (HLB = 5.0) | n-hexyl glucoside % (w/w) | Clarity interval for concentrate (° C.) | Diluted 1:10 Stability/clarity interval 2 days |
|---|---|---|---|---|---|---|---|
| A | 3.5 | 1.5 | | | 6.0 | 0-58 | Separated |
| B | 3.0 | 2.0 | | | 6.0 | 0-62 | Hazy |
| C | 4.5 | | 0.5 | | 6.0 | 0-52 | Hazy |
| D | 3.5 | | 1.5 | | 6.0 | 0-65 | Hazy |
| E | 3.0 | | 2.0 | | 6.0 | 0-68 | Hazy |
| F | 4.5 | | | 0.5 | 6.0 | 0-56 | Separated |
| G | 3.5 | | | 1.5 | 6.0 | 0-61 | Hazy |
| H | 3.0 | | | 2.0 | 6.0 | 0-62 | Hazy |

Compositions A-H are comparisons, where the second nonionic has an HLB-value below 6.4.

TABLE 6

| Composition | 2-Propyl-heptanol + 5EO % (w/w) | $C_9C_{11}$-alcohol + 6EO % (w/w) (HLB = 6.2) | $C_{11}$-alcohol + 10 EO % (w/w) (HLB = 7.2) | $C_9C_{11}$-alcohol + 5.3EO + 4.5PO % (w/w) (HLB = 5.4) | n-hexyl glucoside % (w/w) | Clarity interval for concentrate (° C.) | Diluted 1:10 Stability/clarity interval 2 days |
|---|---|---|---|---|---|---|---|
| I Comparison | 3.0 | 2.0 | | | 6.0 | 0-64 | Hazy |
| J Comparison | 3.0 | | | 2.0 | 6.0 | 0-42 | Separated |

TABLE 6-continued

| Composition | 2-Propyl-heptanol + 5EO % (w/w) | $C_9C_{11}$-alcohol + 6EO % (w/w) (HLB = 6.2) | $C_{11}$-alcohol + 10 EO % (w/w) (HLB = 7.2) | $C_9C_{11}$-alcohol + 5.3EO + 4.5PO % (w/w) (HLB = 5.4) | n-hexyl glucoside % (w/w) | Clarity interval for concentrate (° C.) | Diluted 1:10 Stability/clarity interval 2 days |
|---|---|---|---|---|---|---|---|
| 15 | 3.5 | | 1.5 | | 6.0 | 0-65 | 0-40 |
| 16 | 3.0 | | 2.0 | | 6.0 | 0-70 | 0-49 |

Some further compositions where the second nonionic has an HLB-value below 6.4 are compared with compositions where the nonionic has an HLB-value above 6.4.

The invention claimed is:

1. A clear homogeneous aqueous ready-to-use composition containing a) 0.05-1% by weight of an alkylene oxide adduct of a $C_8$-$C_{12}$ alkyl-branched alcohol b) 0.15-2% by weight of an alkali hydroxide and/or an alkaline complexing agent c) 0.025-1.75% by weight of a hexyl glycoside and/or an octyliminodipropionate d) 0.025-1.25% by weight of a second surface active nonionic alkylene oxide adduct having an HLB-value of at least 6.4 according to Davies.

2. A composition according to claim 1 where the weight ratio between the alkyl-branched alcohol alkylene oxide adduct (a) and the sum of the hexyl glycoside and/or the octyliminodipropionate and the second nonionic alkylene oxide adduct (c+d) is between 1:0.75 to 1:5.

3. The composition of claim 1 where the alkyl-branched alcohol alkylene oxide adduct has the formula $R_1O(PO)_m(CH_2CH_2O)_nH$, where $R_1$ is a branched alkyl group having 8-12 carbon atoms, PO is a propyleneoxy group, m is a number between 0 and 3, and n is a number between 1 and 8.

4. The composition of claim 1 where $R_1$ is 2-ethylhexyl or 2-propylheptyl.

5. The composition of claim 1 where the second nonionic has an HLB value between 6.4 and 15.0 according to Davies.

6. The composition of claim 1 where the second nonionic has the formula $R_2O(C_2H_4O)_x(AO)_yH$, where $R_2$ is an alkyl group containing 9-20 carbon atoms, AO is an alkyleneoxy group with 3-4 carbon atoms, x is a number between 5 and 100 and y is a number between 0 and 4.

7. The composition of claim 6 where $R_2$ is an alkyl group containing 9-14 carbon atoms and AO is an alkyleneoxy group with 3 carbon atoms.

8. The composition of claim 6 where y=0.

9. The composition of claim 6 where component c) is a hexyl glycoside.

10. The composition of claim 6 where component c) is an octyliminodipropionate.

11. An aqueous clear homogeneous concentrate containing a) 1.0-20% by weight of an alkylene oxide adduct of a $C_8$-$C_{12}$ alkyl-branched alcohol b) 3.0-40% by weight of an alkali hydroxide and/or an alkaline complexing agent c) 0.5-35% by weight of a hexyl glycoside and/or an octyliminodipropionate and d) 0.5-25% by weight of a second surface active nonionic alkylene oxide adduct having an HLB-value of at least 6.4 according to Davies, which after dilution with water forms a ready-to-use solution in accordance with claim 1.

12. An aqueous concentrate according to claim 11 having a clarity interval between 5 and 40° C.

13. The aqueous concentrate of claim 11 where component c) is a hexyl glycoside.

14. The aqueous concentrate of claim 11 where component c) is an octyliminodipropionate.

15. A method of cleaning hard surfaces which comprises contacting said surfaces with a cleaning effective amount of the composition of claim 1.

16. A hard surface cleaner that comprises the composition of claim 1.

17. The composition of claim 6 where $R_2$ is an alkyl group containing 9-14 carbon atoms, AO is an alkyleneoxy group with 3 carbon atoms, y=0 and component c) is a hexyl glycoside.

18. The composition of claim 17 where component c) is an octyliminodipropionate.

19. The composition of claim 1 where the alkyl-branched alcohol alkylene oxide adduct has the formula $R_1O(PO)_m(CH_2CH_2O)_nH$, where $R_1$ is a branched alkyl group having 8-12 carbon atoms, PO is a propyleneoxy group, m is a number between 0 and 3, and n is a number between 1 and 8, and said second nonionic has the formula $R_2O(C_2H_4O)_x(AO)_yH$, where $R_2$ is an alkyl group containing 9-20 carbon atoms, AO is an alkyleneoxy group with 3-4 carbon atoms, x is a number between 5 and 100 and y is a number between 0 and 4.

* * * * *

UNITED STATES PATENT AND TRADEMARK OFFICE

CERTIFICATE OF CORRECTION

PATENT NO. : 7,608,576 B2
APPLICATION NO. : 10/555578
DATED : October 27, 2009
INVENTOR(S) : Company et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 427 days.

Signed and Sealed this

Twelfth Day of October, 2010

David J. Kappos

David J. Kappos
*Director of the United States Patent and Trademark Office*